United States Patent [19]

Talley

[11] Patent Number: 4,612,696

[45] Date of Patent: Sep. 23, 1986

[54] ROBOT APPARATUS FOR HANDLING WIRE WORKPIECE DURING TERMINATION

[75] Inventor: Lloyd A. Talley, Valinda, Calif.

[73] Assignee: Eubanks Engineering Co., Monrovia, Calif.

[21] Appl. No.: 702,146

[22] Filed: Feb. 15, 1985

[51] Int. Cl.[4] ..... H01R 43/04

[52] U.S. Cl. ..... 29/564.4; 29/753; 81/9.51

[58] Field of Search ..... 29/564.4, 564.6, 33 M, 29/759, 753, 747, 748; 81/9.51

[56] References Cited

U.S. PATENT DOCUMENTS

| | | | |
|---|---|---|---|
| 3,570,100 | 3/1971 | Kindell et al. | 29/564.4 |
| 3,659,328 | 5/1972 | Klein | 29/564.4 X |
| 3,769,681 | 11/1973 | Eubanks | 29/564.4 |
| 3,872,584 | 3/1975 | Chick et al. | 29/564.4 |
| 4,165,768 | 8/1979 | Gundmestad | 29/753 X |
| 4,403,383 | 9/1983 | Dewhurst et al. | 29/564.4 |
| 4,441,386 | 4/1984 | Hara | 29/564.4 X |
| 4,479,407 | 10/1984 | Mikami et al. | 81/9.51 |
| 4,506,566 | 3/1985 | Schmid | 29/759 |

*Primary Examiner*—William R. Briggs

*Attorney, Agent, or Firm*—William W. Haefliger

[57] ABSTRACT

Wire section handling apparatus, for use with separately supported wire section terminating means, comprising (a) an arm, structure supporting the arm for pivotal displacement between first and second positions, and means to pivot the arm, (b) a head on the arm including a clamp to grip the wire section when the arm has been pivotally displaced to said first position, so that the wire section may be transported by the arm to said second position, (c) the head having a guide thereon adapted to telescopically interfit a locating guide at said second position, thereby to accurately locate the wire section for termination thereof, (d) an actuator to extend the arm in said second position to effect said telescopic interfit, and position the wire section for termination, (e) whereby the arm may subsequently be retracted and the clamp unclamped, to free the wire from the arm and head.

23 Claims, 31 Drawing Figures

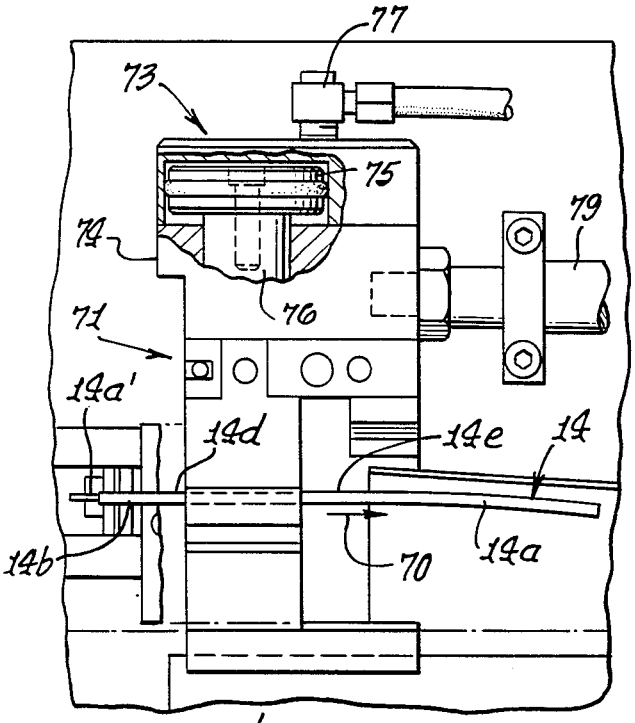
FIG. 3.
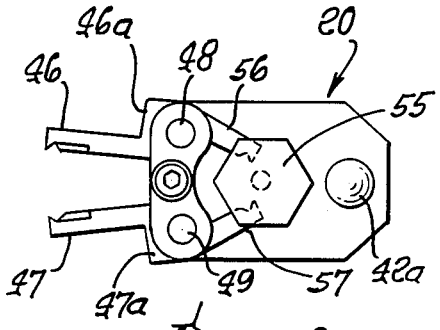
FIG. 6.
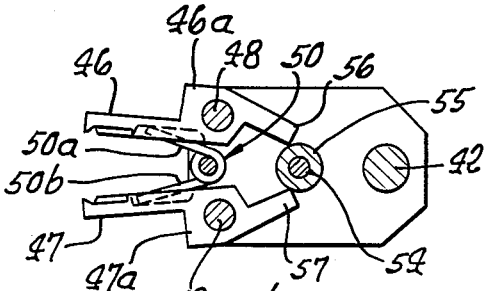
FIG. 7.
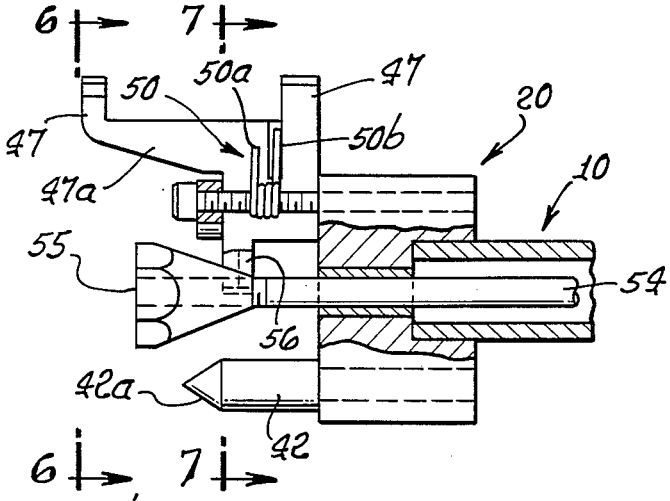
FIG. 5.
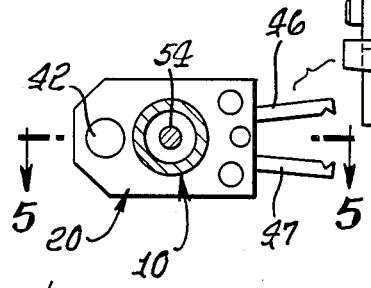
FIG. 4.
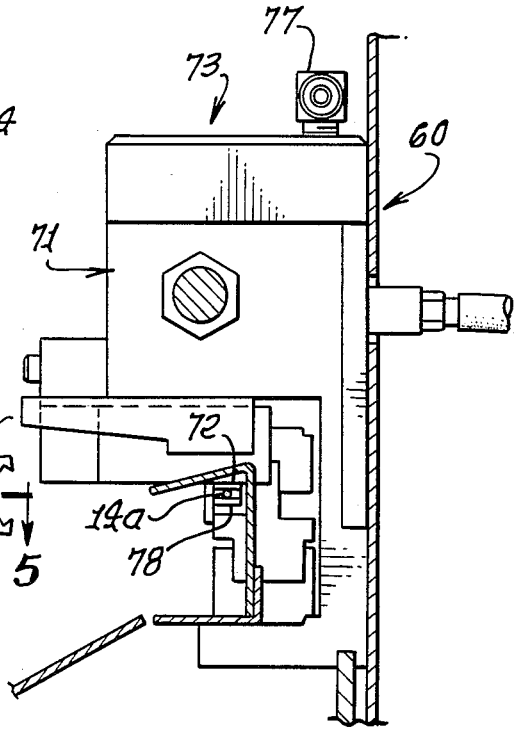

23
53
28
19
30
90
112
93
26
11
40
90a
12
172
64
173
35
33
31
66
171
67
170
39
~81~
32
69
32a
19
11
35b
35a
~22~
10a
10
13
20
42
55
46
47
127
14
23
129
21
42a
44

42
20
42a
54
55
10
47
46
14b
14a
14
22

ROBOT APPARATUS FOR HANDLING WIRE WORKPIECE DURING TERMINATION

BACKGROUND OF THE INVENTION

This invention relates generally to the terminating, such as deforming, of wire sections; and more specifically concerns compact, automatically operable wire section transport means that accomodates to different equipment means, one of which supplies the wire sections to be so terminated, and other of which operates to terminate the wire sections presented to it.

Insulated wire commonly is severed into sections, one or both ends of which are stripped of insulation for later use. Such operations may be carried out in first automatic apparatus. There is the need for "terminating" stripped wire sections, i.e. deforming them in some way, or connecting clips or other devices to them. Terminating operations may be carried at second apparatus completely independently of the described first apparatus. In this event, it is time consuming and expensive to collect sections from the first apparatus and somehow present them for processing by the second apparatus, since the two machines are incompatible.

SUMMARY OF THE INVENTION

It is a major object of the invention to provide a solution to the above incompatibility problem through the provision of automatic apparatus which adapts to both of the separate machines, and makes it possible to terminate the wire sections in sequence, as they are severed and stripped. Accordingly, it is not then necessary to design and purchase new equipment embodying all of the functions of wire severing, stripping, and terminating, in one expensive machine.

Basically, the invention, in one of its forms is embodied in the combination that includes:

(a) a wire section supply apparatus including a locating clamp to clamp a wire section at a mid-portion thereof, with end portions of the section freely exposed for gripping, at predetermined locations, (b) a wire section terminating apparatus, non-integral with said wire section supply apparatus, (c) and arm means including a wire section clamp, associated with one of said (a) and (b) apparatus, and movable between a first position in which the clamp grips the wire section at said predetermined locations, and a second position in which the gripped wire section has been accurately presented to said (b) apparatus for termination.

More specifically, wire section handling apparatus may be carried by the wire section supply machine, for use with the separately supported wire section terminating machine, and may comprise:

(a) an arm means supporting the arm for pivotal displacement between first and second positions, and means to pivot the arm, (b) a head on the arm including a clamp to grip the wire section when the arm has been pivotally displaced to said first position, so that the wire section may be transported by the arm to said second position, (c) the head having a guide thereon adapted to telescopically interfit a locating guide at said second position, thereby to accurately locate the wire section for termination thereof, (d) means to extend the arm in said second position to effect said telescopic interfit, and position the wire section for termination, (e) whereby the arm may subsequently be retracted and the clamp unclamped, to free the wire from the arm and head.

As will appear, the means supporting the arm may include a carriage mounted to pivot about a first axis and between first and second carriage positions corresponding respectively to said first and second arm positions, and a first actuator operatively connected with the carriage to pivot same about said first axis. Further, the means to extend the arm may include a second actuator to displace the arm along a second axis extending lengthwise of the arm, said second actuator also carried by the carriage. Also, a third actuator is carried by the carriage and connected with said clamp to effect operation thereof to clamp and unclamp the wire section, and a rotary actuator may be carried by the carriage and operatively connection with the head to effect rotation thereof after the arm is pivoted from said first position and prior to arm arrival at said second position.

A further object is to provide a means temporarily to block pivoting of the arm to said first position until the wire section is located in predetermined position to be gripped by said clamp on the head. A locating clamp may be associated with wire strand severing and insulation stripping apparatus, to locate a succession of wire sections in said predetermined position, and an actuator to operate said locating clamp to successively clamp said sections at said predetermined position and to release same when the clamp on the head grips the sections.

An additional object includes the provision of a stop shoulder on the head engagable with a stop shoulder associated with said terminating means, to limit extension of the arm in said second position when the wire section is positioned for termination.

Finally, the terminating means may include hammers, or hammer and anvil structures characterized in that the hammer bodily deflects the wire section toward the anvil, said telescopic interfit of the guide and locating guide providing sufficient clearance to permit corresponding bodily deflection of the head and clamp.

These and other objects and advantages of the invention, as well as the details of an illustrative embodiment, will be more fully understood from the following specification and drawings, in which:

DRAWING DESCRIPTION

FIG. 3 is an enlarged view on lines 3—3 of FIG. 2, showing details of a clamp assembly;

FIG. 4 is a section taken on lines 4—4 of FIG. 2, to show the position of jaws on an arm, and wire position, as in FIG. 2;

FIG. 5 is a section on lines 5—5 of FIG. 4;

Figure 1:
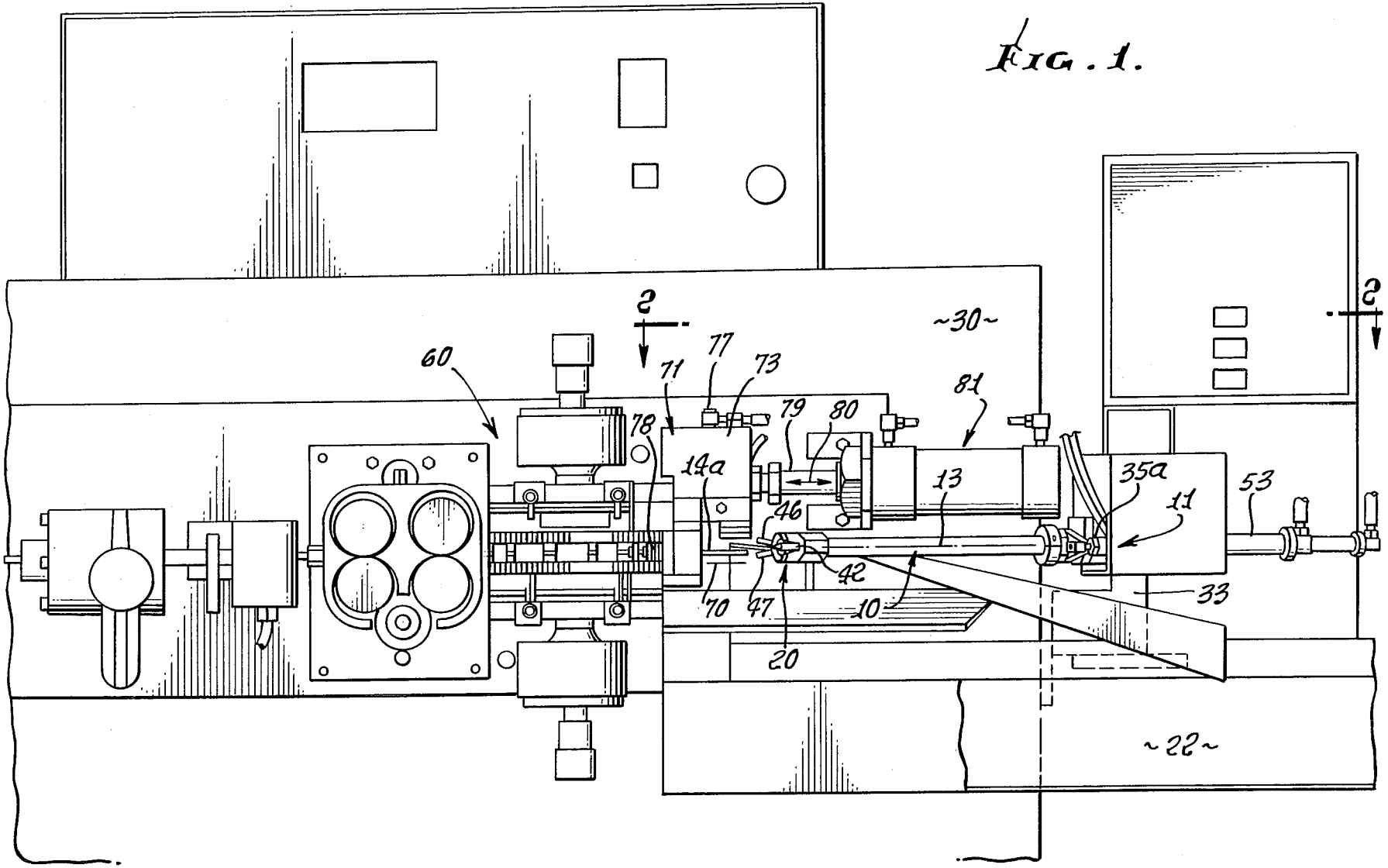
FIG. 1 is a front elevational view of a stripper and apparatus including an articulated arm to pick up a wire to be terminated.
Figure 2:
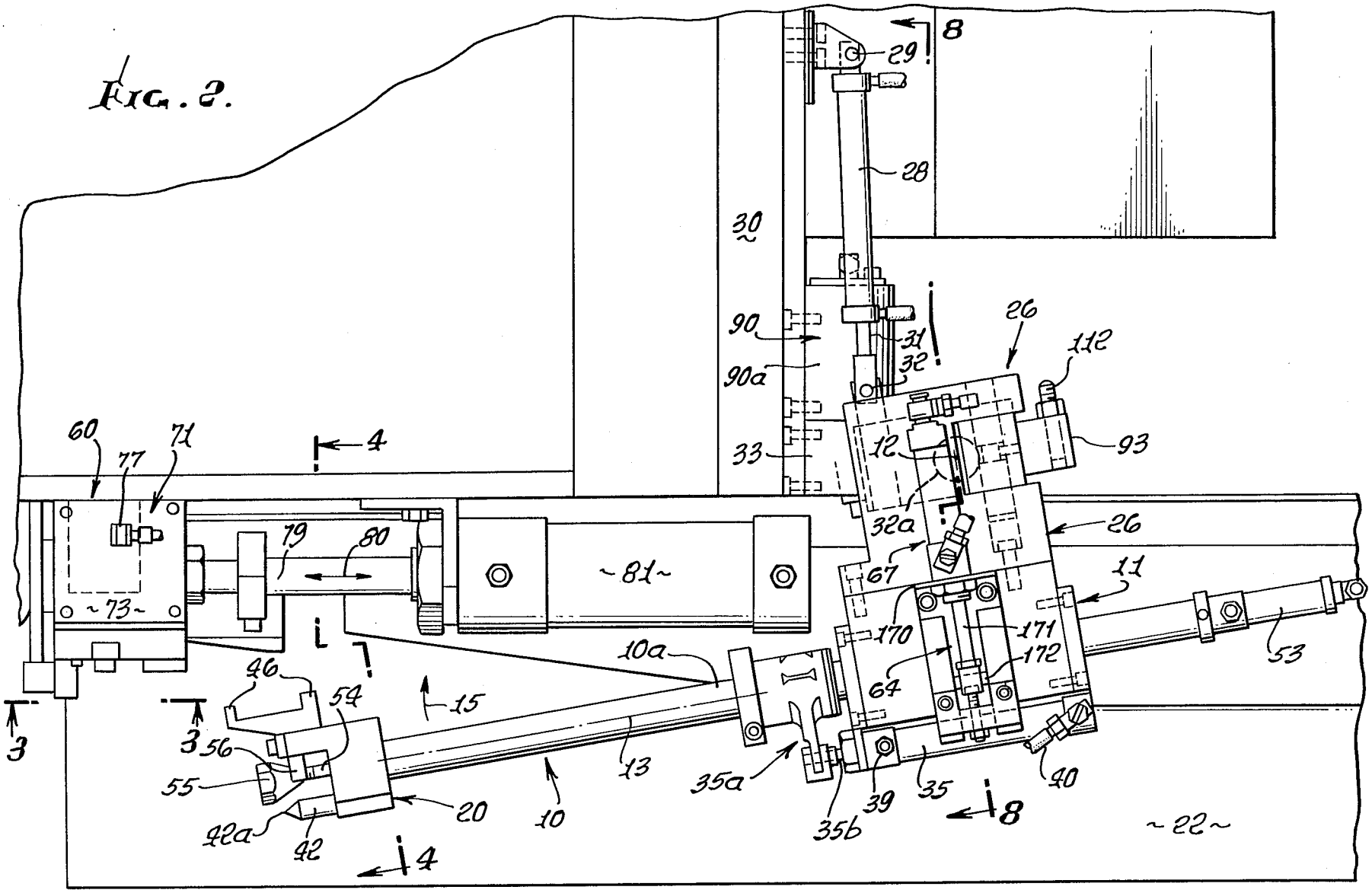
FIG. 2 is a plan view taken on lines 2—2 of FIG. 1, showing beginning of cycle.
Figure 8:
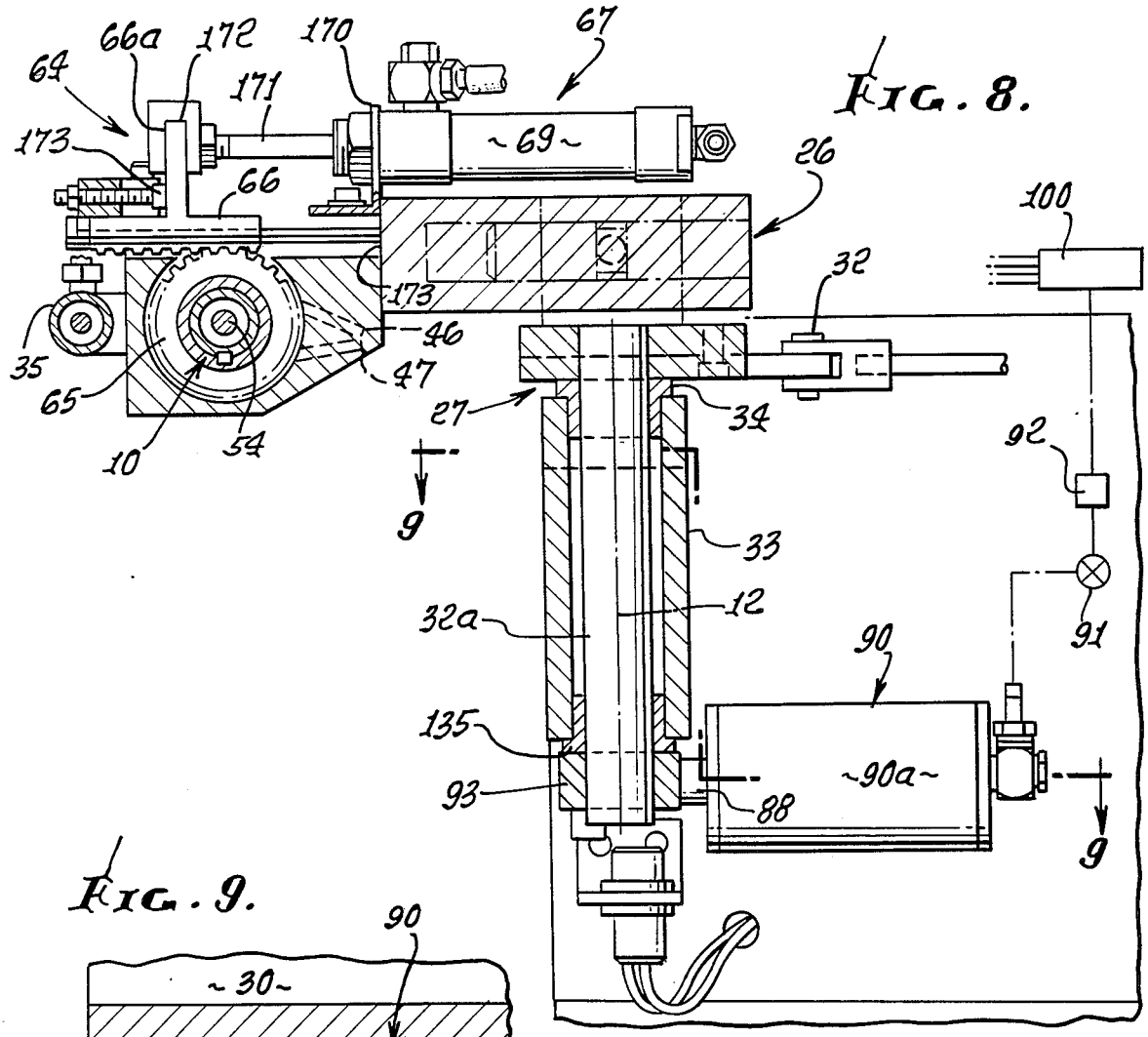
Figure 9:
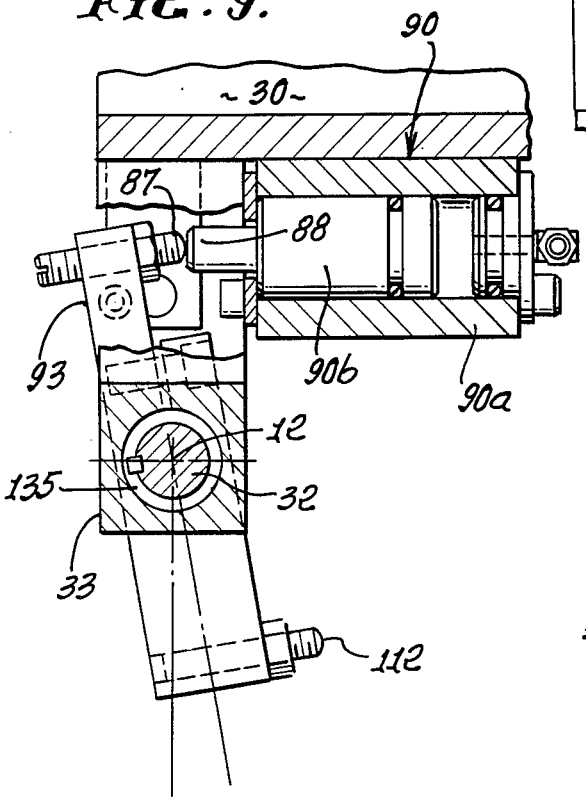
Figure 10:
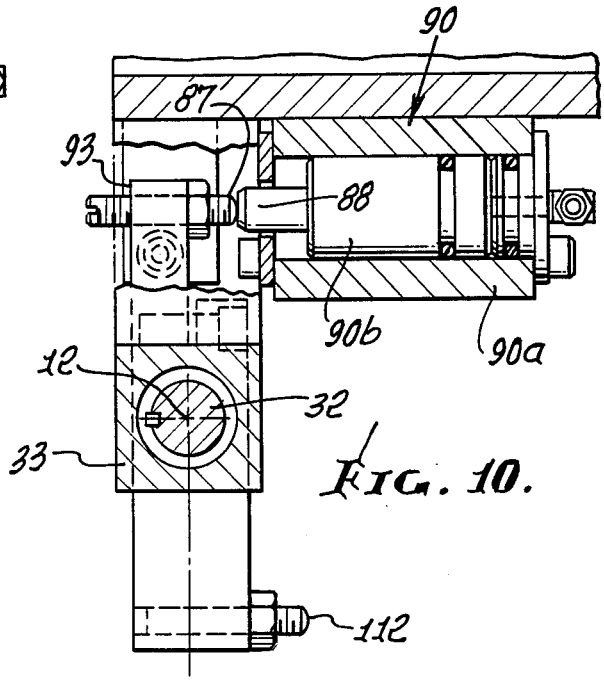
Figure 11:
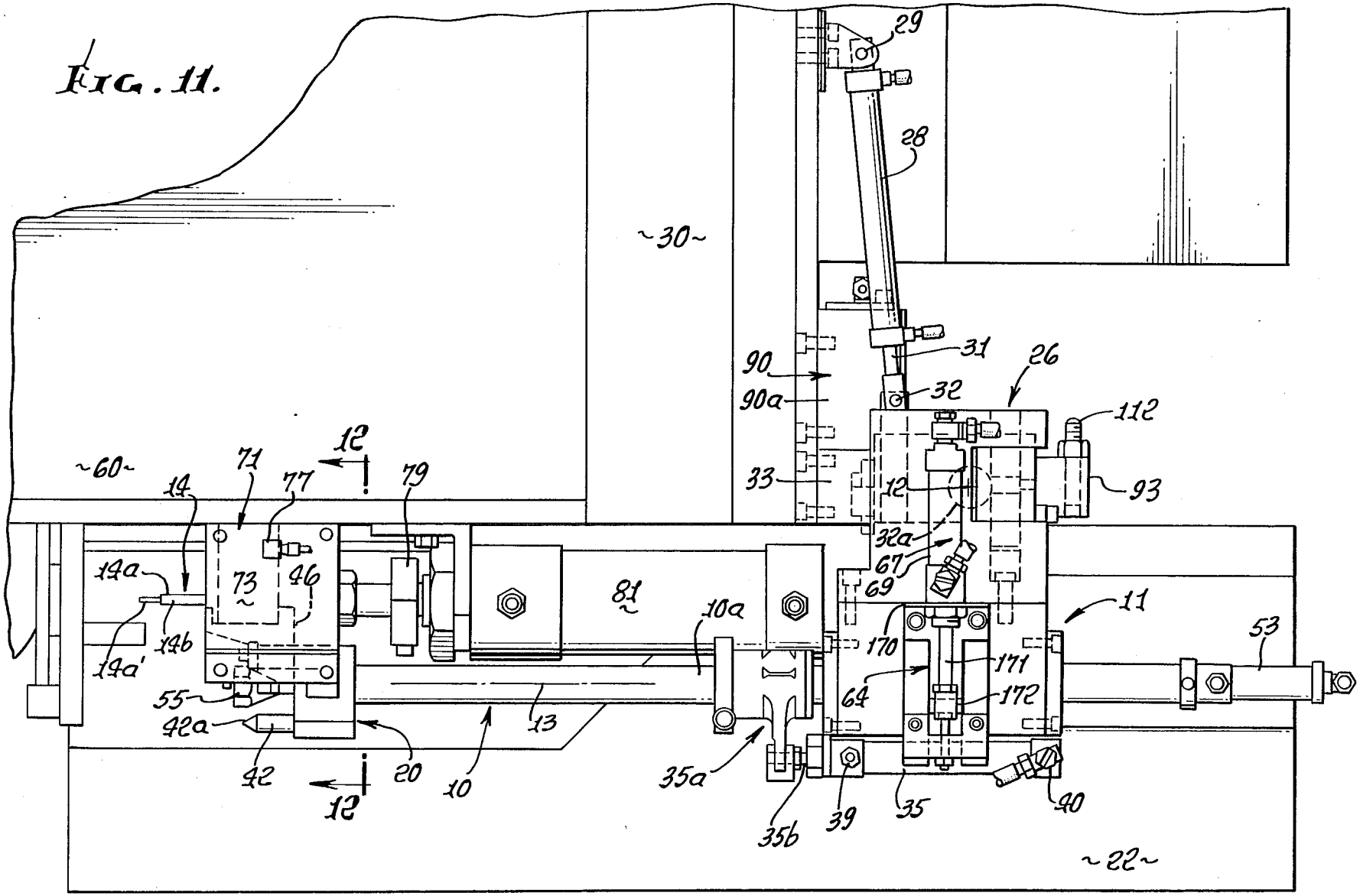
Figure 12:
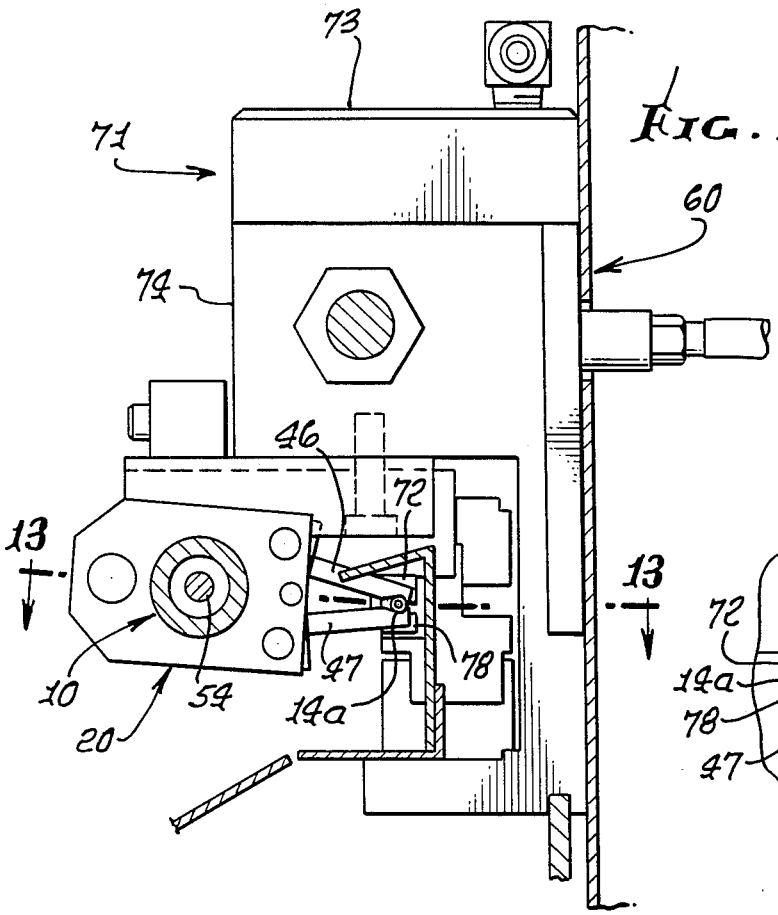
Figure 14:
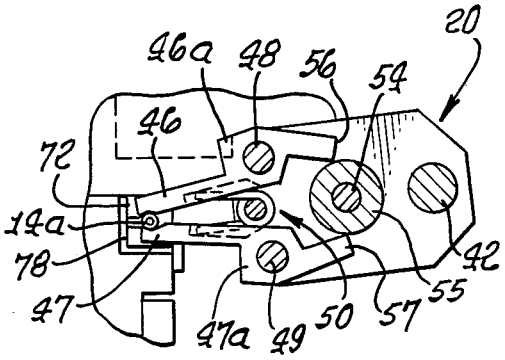
Figure 13:
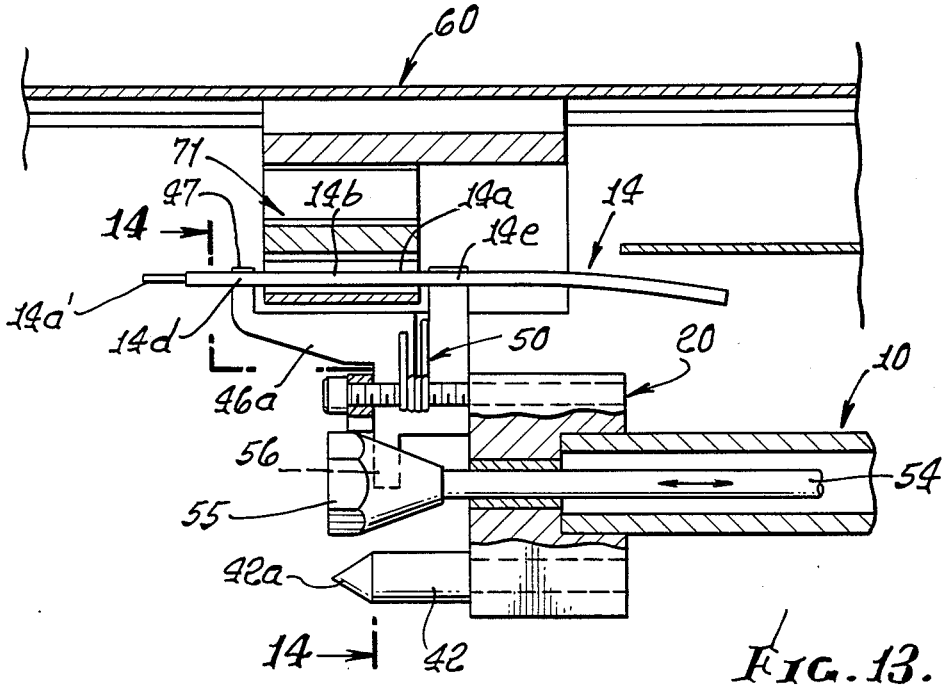
Figure 15:
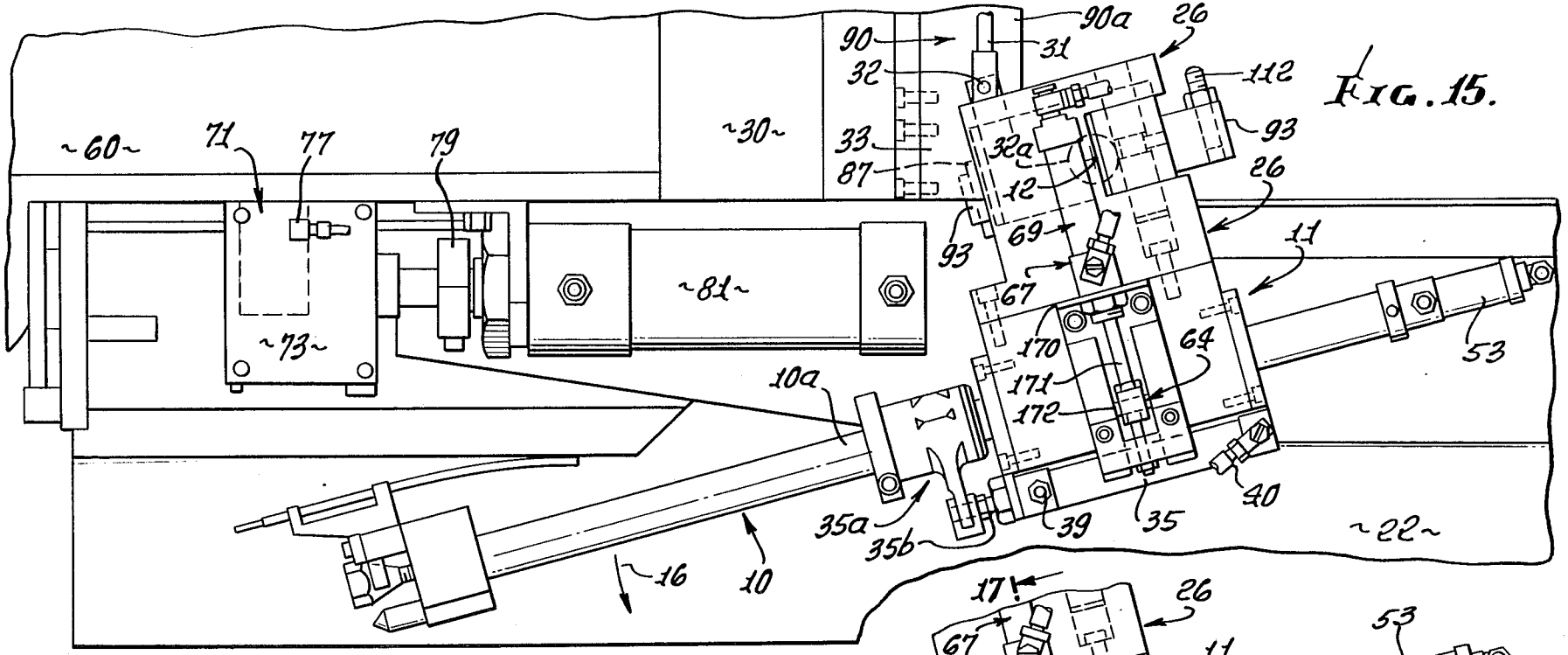
Figure 16:
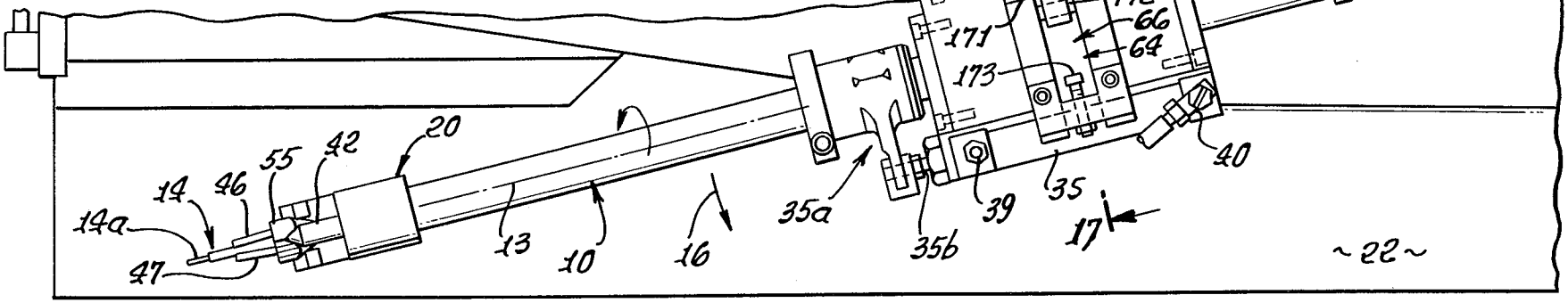
Figure 17:
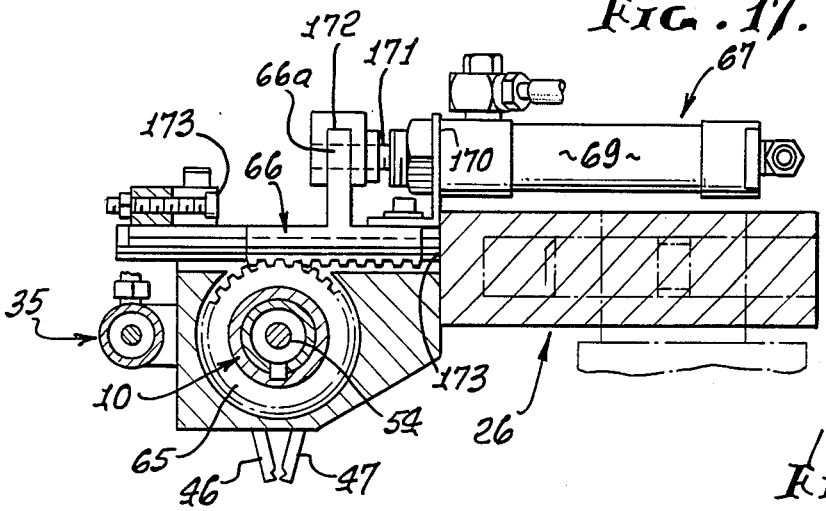
Figure 20:
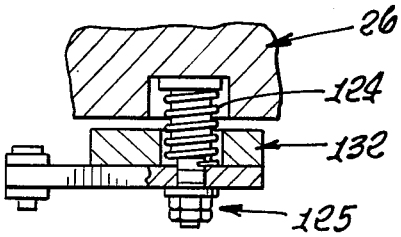
Figure 19:
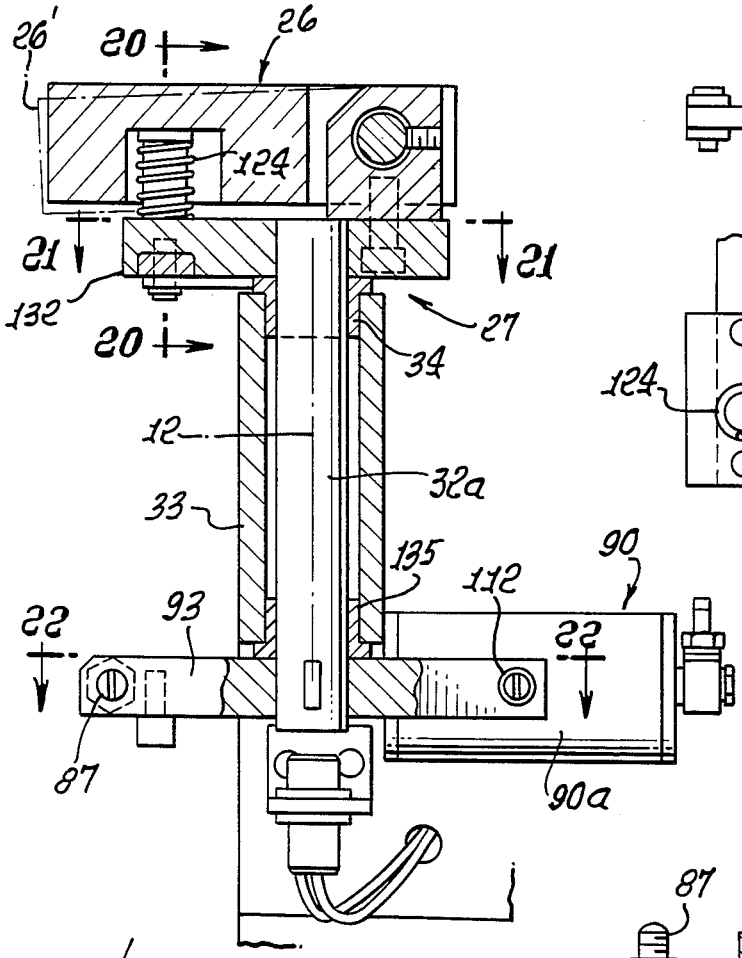
Figure 21:
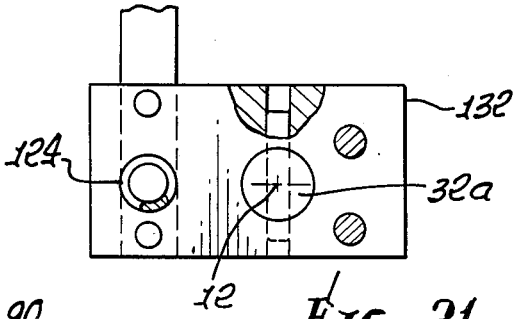
Figure 22:
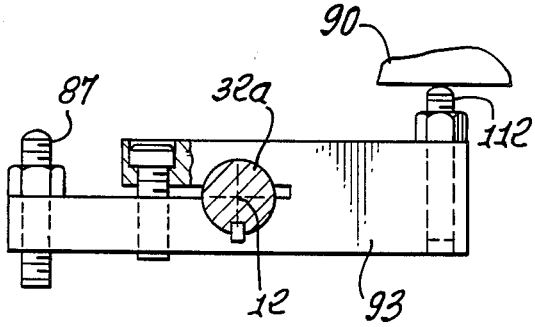
Figures 18, 31:
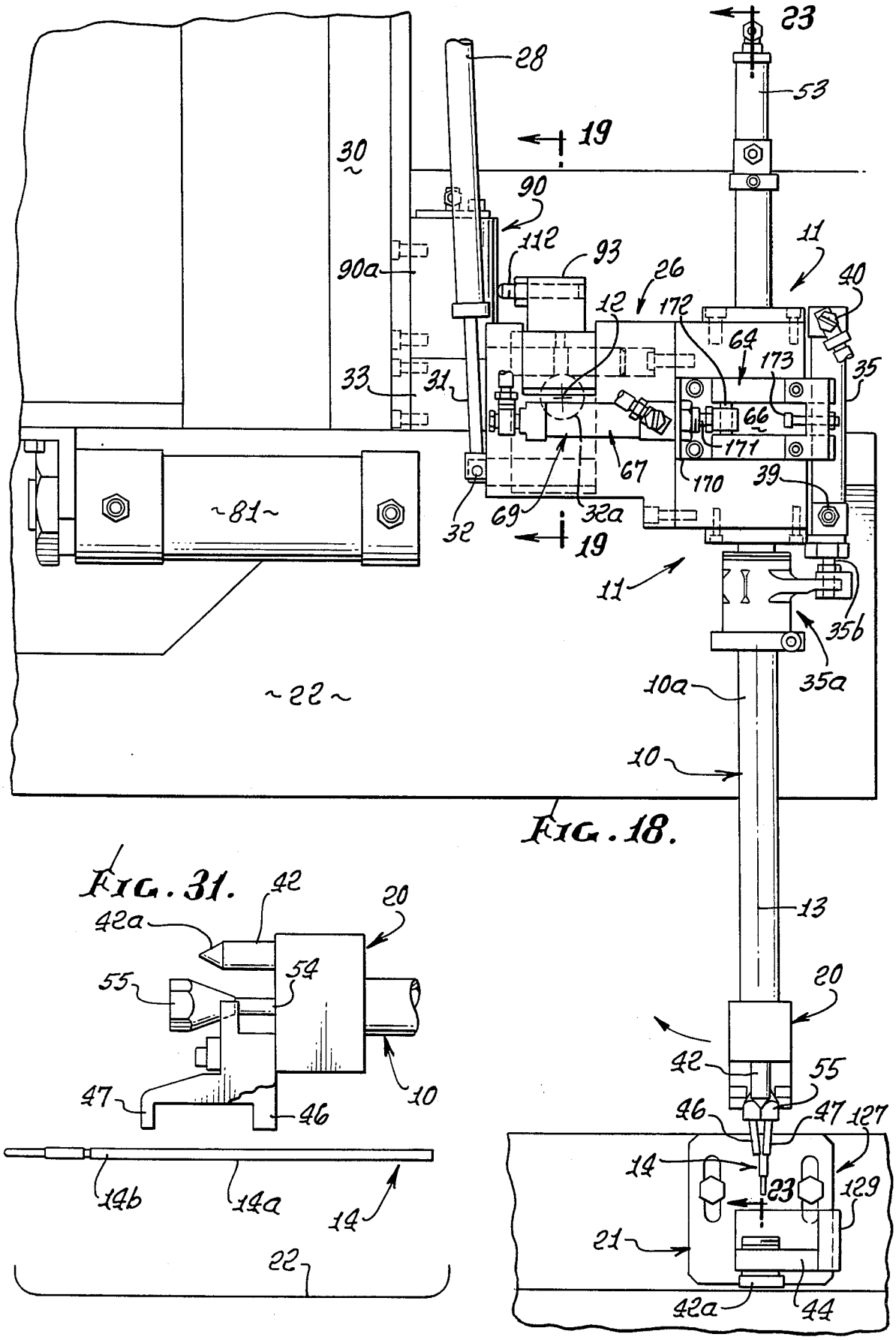
Figures 23, 24:
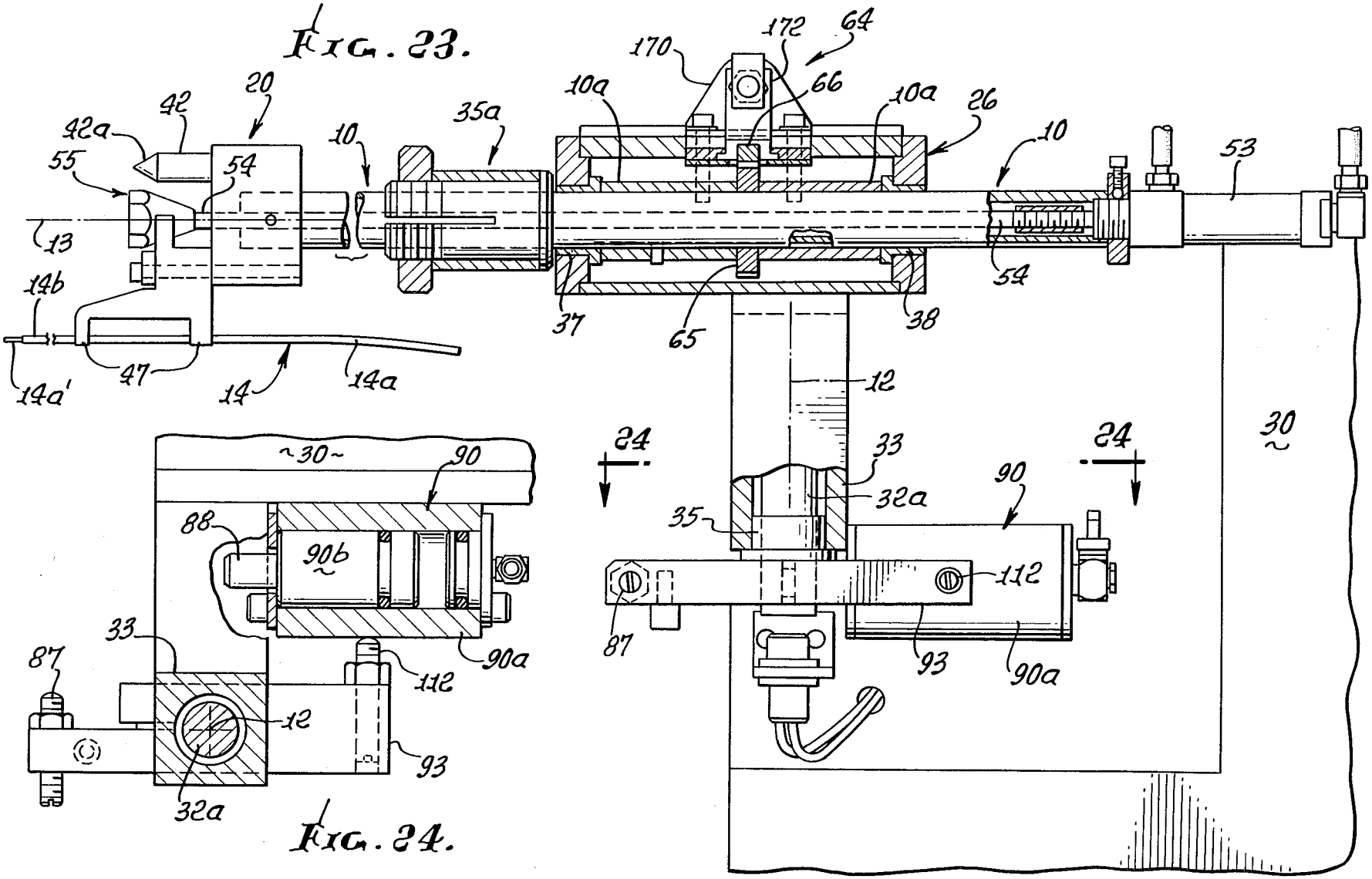
Figures 25, 26, 27:
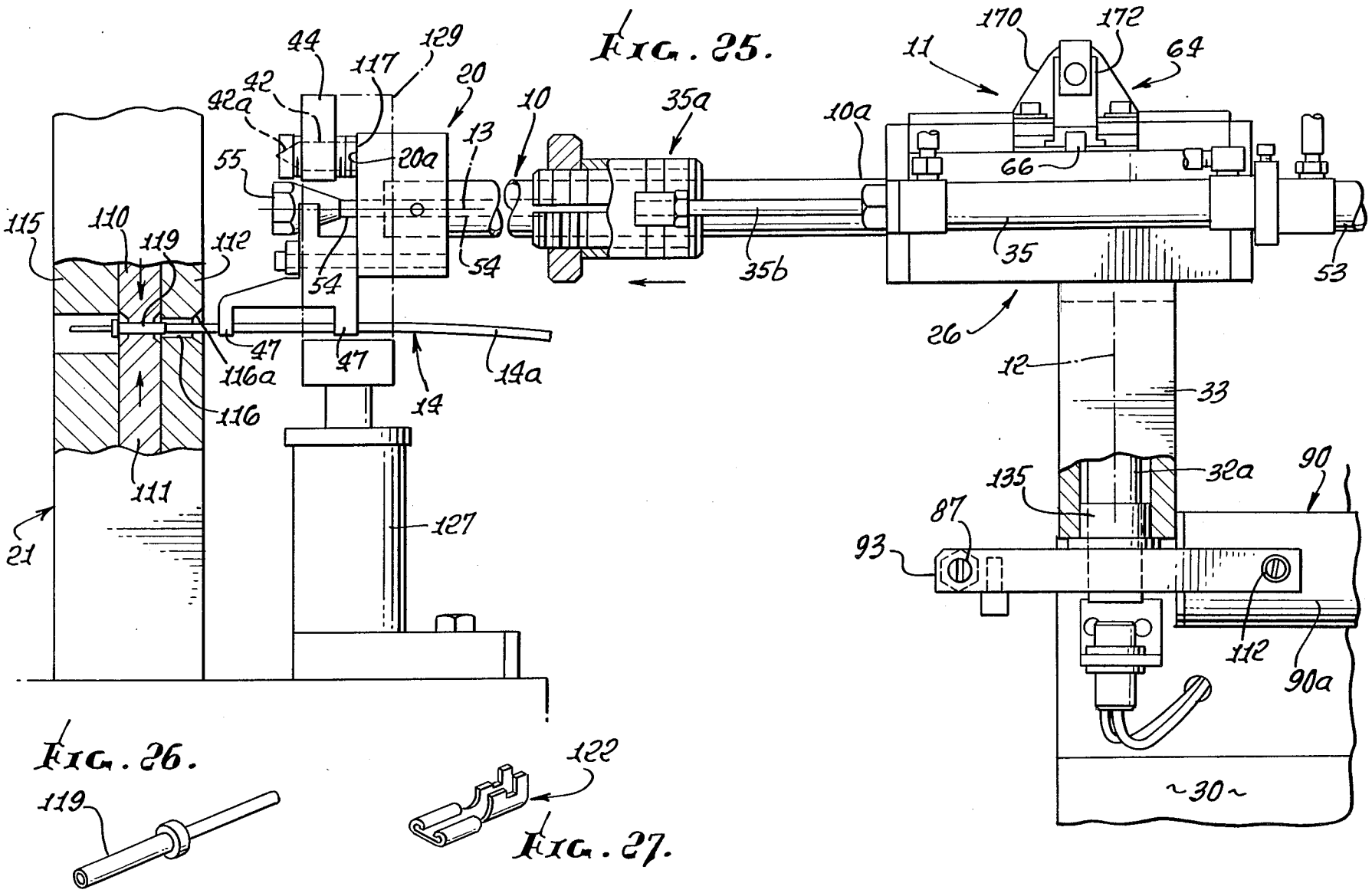
Figures 28, 29, 30:
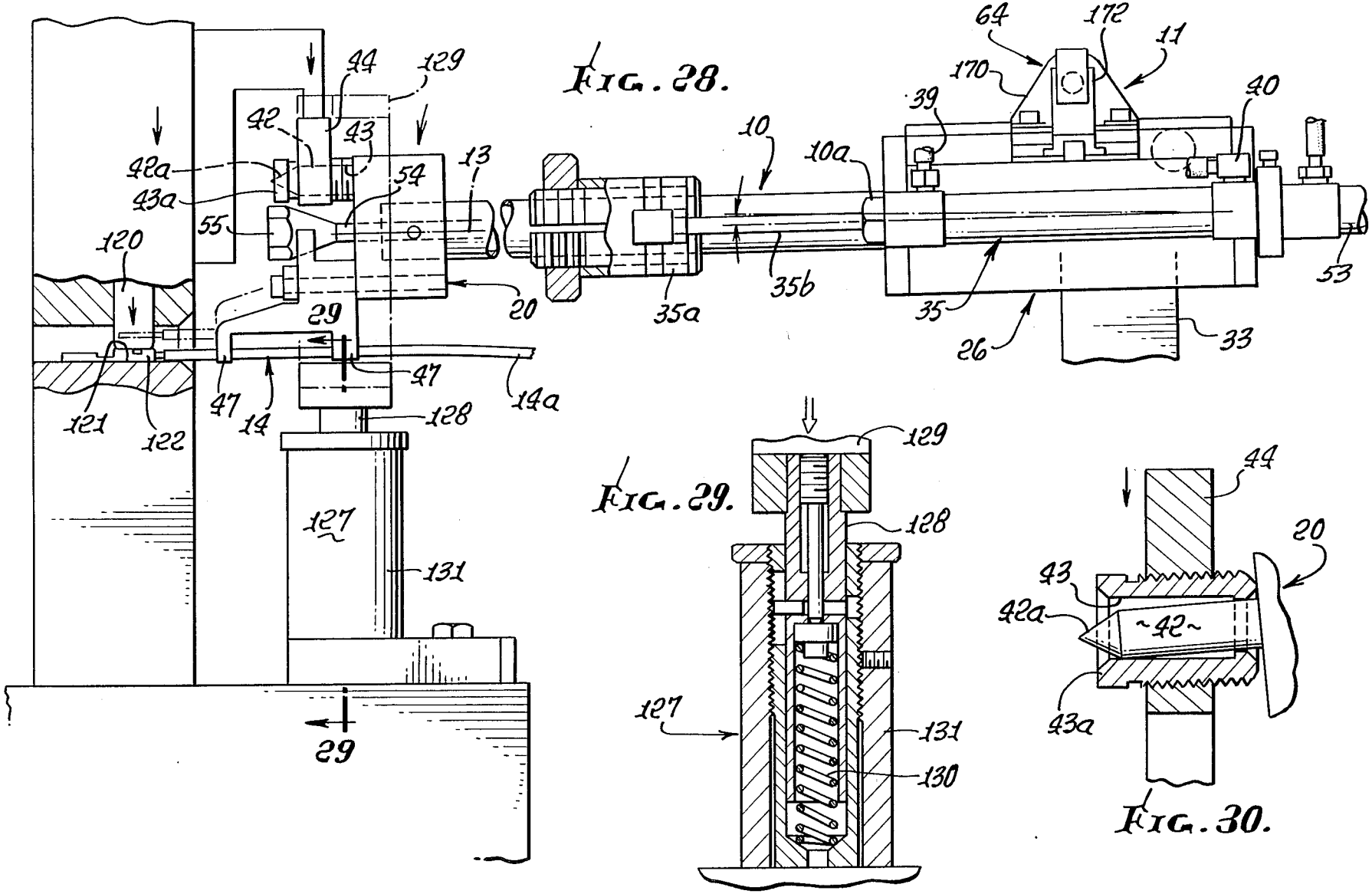

FIGS. 6 and 7 are detailed sections on lines 6—6 and 7—7 of FIG. 5 to show jaw construction;

FIG. 8 is a section on lines 8—8 of FIG. 2; and shows arm rotating mechanism;

FIG. 9 is a section on lines 9—9 of FIG. 8;

FIG. 10 is a view like FIG. 9, but showing the arm rotated, as also shown in FIG. 11;

FIG. 11 shows the second step of the cycle, and is a view like FIG. 2;

FIG. 12 is a vertical section taken on lines 12—12 of FIG. 11, showing clamping of wire by the jaws;

FIG. 13 is a horizontal cross-section taken on lines 13—13 of FIG. 12, illustrating registry of jaw assembly with clamp assembly;

FIG. 14 is a fragmentary cross-section on lines 14—14 of FIG. 13;

FIG. 15 is a view like FIG. 1, showing the arm rotated back away from FIG. 2 position;

FIG. 16 is a view like FIG. 15, but with the arm rotated about its arm axis, to orient the wire end, for termination;

FIG. 17 is an enlarged section on lines 17—17 of FIG. 16, showing rotary action of rack and pinion;

FIG. 18 is a top plan view of the articulated arm, rotated and oriented adjacent the target fixture;

FIG. 19 is an enlarged view taken on lines 19—19 of FIG. 18, showing attachment of the wrist;

FIG. 20 is a fragmentary section on lines 20—20 of FIG. 19;

FIG. 21 is a horizontal cross section on lines 21—21 of FIG. 19, showing upper construction of swing-out assembly;

FIG. 22 is taken on lines 22—22 of FIG. 19, showing lower construction of swing-out assembly;

FIG. 23 is an enlarged vertical fragmentary cross-section on lines 23—23 of FIG. 18;

FIG. 24 is a fragmentary horizontal cross-section taken on lines 24—24 of FIG. 23;

FIG. 25 is a view similar to FIG. 23, but showing jaws closed on wire, arm extended, and wire in termination assembly;

FIGS. 26 and 27 are perspective views of pin and clip members used to terminate a stripped wire end;

FIG. 28 is a view like FIG. 25, showing arm extended and located in target assembly; but the terminator is modified and employs the clip of FIG. 27 to be connected to stripped wire end;

FIG. 29 is a fragmentary vertical cross-section on lines 29—29 of FIG. 28, showing a spring incorporated in the target assembly;

FIG. 30 is an enlarged fragmentary view of the locating pin and the target receptor, showing lost-motion interfit to accomodate tonking;

FIG. 31 shows jaws opened, and wire and pin dropped into a hopper.

GENERAL ORGANIZATION

Referring to the drawings, an arm 10 is supported by means 11 to pivot about an axis 12 (which may be vertical), between a first position ( a wire section receiving and gripping position) as viewed in FIG. 11, and a second position (as in FIG. 18 wherein the arm may be linearly extended in the direction of its length axis 13 for termination of the wire section 14). Transitional positions of the arm 10 are seen in FIG. 2 (wherein arm 10 is approaching its FIG. 11 position, see arrow 15) and FIG. 15 (wherein the arm is pivoting away from FIG. 11 position and toward the second position of FIG. 18, see arrow 16) and FIG. 16, wherein the arm is rotated 90° about its length axis 13, during pivotal transit toward FIG. 18 position. FIG. 25 shows the arm in FIG. 18 position, but the head 20 on the arm extended leftwardly into wire terminating position, wherein apparatus 21 is operable to "terminate" the wire section 14. The head 20 is subsequently linearly retracted, as to the right in FIG. 25, and the arm rotated back toward FIG. 11 position, the wire section then being released and dropped into a hopper 22 during such arm swinging (see FIG. 31).

DETAILED DESCRIPTION

The means supporting the arm 10 typically includes a carriage 26 mounted at 27 (see FIGS. 2 and 8) to pivot about first axis 12, which may be vertical, and between first and second carriage positions corresponding to the above mentioned first and second arm positions. A first actuator 28 is operatively connected with the carriage to pivot same about first axis 12. FIG. 2 shows pneumatic actuator 28 having one cylinder end pivotally supported at 29 to frame structure 30, and a plunger 31 pivotally connected at 32 to carriage 26. FIG. 8 shows the carriage 26 as having an associated vertical shaft **32*a* contained in a support sleeve 33, as by upper rotary and thrust bearing 34, and lower rotary bearing 35. Sleeve 33 may be carried by structure 30**.

The means to extend the arm 10 in second position typically includes a second actuator 35 (see FIG. 18) carried by carriage 26 and suitably connected to the arm 10 at **35*a*. The latter has a tubular portion 10*a* (see FIG. 23) slidable lengthwise in bearings 37 and 38 carried by carriage 26. Actuator 35 may be pneumatic, and has pressure hose connections as shown at 39 and 40, in FIG. 28, and plunger 35*b*. When the arm 10 is advanced in second position (see FIG. 28), a telescopic guide pin 42 on head 20, having a forwardly tapered nose 42*a*, telescopically interfits a locating guide, for example a guide opening 43 in bracket 44, the opening 43 closely fitting the pin to accurately locate the clamped wire section relative to the terminating means 21**, for termination thereby.

The wire section clamp includes multiple jaw elements relatively movable toward and away from one another, and between closed and open positions. See for example upper and lower pairs of jaw elements 46 and 47 in FIGS. 2, 5, 6 and 7. The upper spaced jaw elements 46 are carried on a jaw part **46*a* pivotally supported at 48, by head 20; and the lower spaced jaw elements 47 are carried on jaw part 47*a* pivotally supported at 49 by head 20. When the jaws are closed toward one another, one pair of elements 46 and 47 closes on the wire section at one location therealong, and another pair of elements 46 and 47 closes on the wire section at another location therealong, as in clear from FIG. 23. The jaws are offset from axis 13, so that as arm 10 is pivoted about axis 13, the jaws and wire section 14 swing downwardly from FIG. 15 position to FIG. 16 and 23 position, for reception of the wire section by means 21**.

Biasing means is provided to yieldably bias the jaw elements toward one of the closed and open positions; for example, a tension spring 50 seen in FIG. 7 has arms **50*a* and 50*b* biasing elements 46 and 47 toward open position. A third actuator is operatively connected with the jaw elements to displace them toward the other of the open and closed position—i.e. for example to closed position, for gripping the wire section, as in FIGS. 11–13. That actuator is shown to include a pneumatic actuator cylinder 53 carried by the arm 10, as seen in FIG. 23, to be movable lengthwise axially therewith. The actuator bodily displaces a rod 54 connected with a cam in the form of a cone 55, to linearly bodily and axially displace same, for engaging and rotatably displacing a follower or followers in the form of fingers 56** and 57 respectively integral with jaw elements 46 and 47 (see FIG. 7), to pivot the latter toward closed, wire gripping position (see FIG. 13). Accordingly, the wire section is firmly gripped at two spaced locations alongs its length, to be transported, oriented, and accurately displaced endwise into the terminating apparatus.

A rotary actuator is typically also carried by the carriage and operatively connected with the head to effect head rotation (as between FIG. 15 and FIG. 16 positions), after the arm 10 is retracted or pivoted from FIG. 11 first position, and prior to arm arrival at second position, as exemplified by FIGS. 18, 23 and 28. The extent of such rotation may be 90°, as shown by these figures, accomodating the arm 10 to both the particular wire section supply apparatus 60 shown in FIGS. 1, 2 and 11, and the separate wire terminating apparatus 21, shown in FIGS. 18 and 28. In this regard, these two machines (60 and 21) need not necessarily be interconnected, so that one may be movable relative to the other on the factory floor, yet the apparatus of the present invention allows their use for terminating, at 21, wire sections supplied by an existing supply machine 60. This represents a great saving in cost, since an entirely new machine combining both 60 and 21 is one piece of equipment need not be purchased, or acquired.

The illustrated rotary actuator 64 (see FIGS. 8, 17 and 23) includes a spur gear 65 surrounding and attached to the arm 10, a rack 66 meshing with the gear, and a linear pneumatic actuator 67 connected to the rack to linearly displace same for rotating the gear, arm, head and clamp. See for example, actuator cylinder 69 attached at 70 to the carriage 26; and actuator plunger 71 attached at 72 to the rack. Stop 73 is engagable by rack arm 66*a*, to limit rotation of the gear, head and clamp. Connection 35*a* (FIG. 23) allows arm rotation.

Referring now to FIGS. 1–4, the wire supply apparatus 60 operates to feed a wire strand 14*a* in the direction of arrow 70, and through a clamp assembly generally indicated at 71. At that location, jaws 72 and 78 are activated to grip the strand, an actuator for the upper jaw indicated at 73 and including cylinder 74, a piston 75, piston rod 76 to displace the upper jaw downwardly and connector 77 for pressurized air. A lower jaw appears at 78. The wire strand may also be severed and partially stripped of insulation to expose a bare wire end 14*a*′ projecting from insulation 14*b*. Such severing and stripping means is known in the art, and is generally indicated at 78′. The clamp assembly 71 is shown as carried by an actuator end 79 movable back and forth in the direction of arrows 80, by a pneumatic actuator 81, to locate and hold the stripped and severed wire section 14*a* in predetermined position (see FIG. 3) to be gripped by jaw elements 46 and 47 previously described. Regions 14*d* and 14*e* of the wire section, shown in FIG. 3, are so gripped. See also FIGS. 12–14.

Also provided is a delay means to temporarily block the arm 10 from fully pivoting into wire gripping first position, as shown in FIG. 11, until a wire section 14*a* is, indeed, in correct position to be gripped, as shown in FIG. 3. FIGS. 8–10 and 24 illustrate one form of such delay means to include a part, such as adjustable set screw 87 swingable with arm 10; a stop, such as projection 88 movable between a primary position (FIG. 9) in which it is engaged by part 87 to arrest arm swinging, and a secondary position (see FIG. 10) in which it allows completed swinging of the arm 10 to first (wire section gripping) position; and yieldable means to urge the stop toward FIG. 9 position. Such yieldable means may take the form of the pneumatic cylinder and piston assembly 90, wherein pressurized air, admitted to cylinder 90*a*, urges the piston 90*b* and stop 88 leftwardly. A yieldable stop action is thereby provided to cushion impact by part 87 as the arm swings. When pneumatic pressure is relieved (as via a suitable valve 91, actuated at 92) the stop retracts under arm swinging force application. Part 87 may be carried by a crank 93 clamped to shaft 32*a*. Valve actuator 92 is shown in FIG. 8 as connected to a master control 100, which controls operation of clamp assembly 71 to clamp the wire section 14*a* in FIG. 3 position. Once the latter is achieved or effected, actuator 92 is operated to allow completed swinging of the arm. Arm swinging into FIG. 18 position is limited by engagement of an adjustable stop 112, on crank 93, with the side of cylinder 90*a*. See FIG. 24.

FIGS. 11–14 show the wire gripped by jaw elements 46 and 47, and at spaced locations along the wire sections, i.e., at opposite sides of the locating clamp, whereby the wire is properly oriented for transport to and insertion into the termination apparatus 21. Once the wire is gripped by pairs of jaw elements 46 and 47, the locating clamp is released, by the master control 100, i.e., by upward movement of piston 75 in FIG. 3.

One form of wire section termination is shown in FIGS. 25 and 26 as comprising deforming or peening. For this purpose, the apparatus 21 may include peening hammers 110 and 111, respectively movable downwardly and upwardly to impact the wire section 14*a*, and particularly conductor 119 thereon to locally flatten the section. Hammers are suitably activated, for movement guided by guide plates 112 and 115. Note wire section reception opening 116 in plate, having a countersunk mouth 116*a*. Endwise positioning of the wire is controlled by engagement of surface 20*a* of head 20 against a stop shoulder 117 on apparatus 21. Accordingly, even though apparatus 21 is typically not integral with machine 60, it is made compatible with the latter as respect supplying wire sections to be terminated, and the accomplishment of such termination, by the present invention.

FIGS. 28–30 show the provision of terminating means including hammer and anvil structures, as at 120 and 121 characterized in that the hammer bodily deflects the wire section sidewardly (as for example downwardly) toward the anvil. The action may be provided to enable connection of a metal clip to the wire, by deformation ("tonking") of the clip, one form of which is seen at 122 (see FIG. 27). To this end, the interfit of the telescopic guide 42 and locating guide (bore 43 as shown in FIG. 30) provides sufficient clearance as to permit corresponding downward tilting of the guide 42, while it is in bore 43, as indicated. Tubular guide part 43*a*, and also guide 42, are bodily moved downwardly by structure 44 operatively connected to downwardly moving hammer 120. A device 127 (see FIG. 29) may be provided to cushion the downward movement of the hammer 120 and head 20. It includes a plunger 128 moved downwardly by a bracket connection 129 to structure 44, and compression spring 130 in cylinder 131, as shown. Plunger 128 compresses the return spring, as the hammer 120 moves downwardly as described. The arm 10 is deflected sidewardly and downwardly, during such sideward deflection of the head 20, as accomodated by reaction rocking of the carriage 26. See in this regard the broken lines downwardly tilted position 26′ of the carriage in FIG. 19. A compression spring 124, with tension adjustment at 125, yieldably resists such downward rocking, and is supported on a fixed table 132.

We claim:

1. Wire section handling apparatus, for use with separately supported wire section terminating means, comprising (a) an arm, means supporting the arm for pivotal displacement between first and second positions, and means to pivot the arm, (b) a head on the arm including a clamp to grip the wire section when the arm has been pivotally displaced to said first position, so that the wire section may be transported by the arm to said second position, (c) the head having a guide thereon adapted to telescopically interfit a locating guide at said second position, thereby to accurately locate the wire section for termination thereof, (d) means to extend the arm in said second position to effect said telescopic interfit, and position the wire section for termination, (e) whereby the arm may subsequently be retracted and the clamp unclamped, to free the wire from the arm and head.

2. The combination of claim 1 wherein said means supporting the arm includes a carriage mounted to pivot about a first axis and between first and second carriage positions corresponding respectively to said first and second arm positions, and a first actuator operatively connected with the carriage to pivot same about said first axis.

3. The combination of claim 2 wherein said means to extend the arm includes a second actuator to displace the arm along a second axis extending lenthwise of the arm, said second actuator also carried by the carriage.

4. The combination of claim 3 including a third actuator carried by the carriage and connected with said clamp to effect operation thereof to clamp and unclamp the wire section.

5. The combination of claim 3 including a rotary actuator carried by the carriage and operatively connected with the head to effect rotation thereof after the arm is pivoted from said first position and prior to arm arrival at said second position.

6. The combination of claim 4 wherein said clamp includes multiple jaw elements relatively movable toward and away from one another and between closed and open positions biasing means yieldably biasing the jaw elements toward one of said closed and open positions, said third actuator operatively connected with the jaw elements to displace them toward the other of said open and closed positions.

7. The combination of claim 6 wherein including a cam operated by the third actuator, and cam follower means operatively connected with jaw elements to rotatably displace them in response to linear displacement of the cam by the third actuator.

8. The combination of claim 7 wherein said jaw elements include first and second pairs of jaws, the first pair spaced apart along a wire section and associated with one follower, and the second pair spaced apart along the wire section and associated with a second follower, each follower rotatably displaced by the cam as it moves axially linearly, whereby the wire section is gripped by jaws of the first and second pairs, and at two locations spaced along the wire section length, to accurately orient the wire section, endwise.

9. The combination of claim 5 wherein said rotary actuator includes a spur gear attached to the arm, to rotate therewith, a rack meshed with said gear, and a linear actuator connected with the rack to linearly displace the rack, and thereby rotate the gear, arm and head.

10. The combination of claim 1 including means to temporarily block pivoting of the arm to said first position until the wire section is located in predetermined position to be gripped by said clamp on the head.

11. The combination of claim 10 including a locating clamp associated with wire strand severing and insulation stripping apparatus, to located a succession of wire section in said predetermined position, and an actuator to operate said locating clamp to successively clamp said sections in said predetermined position and to release same when the clamp on the head grips each section.

12. The combination of claim 10 wherein said temporary blocking means includes a part swingable with said arm, a stop movable between a primary position in which it is engaged by said part, and a secondary position in which the stop allows completed swinging of the arm to said first position, and yieldable means to urge the stop into said primary position.

13. The combination of claim 12 including means to control said yieldable means to allow completed swinging of the arm to first position after clamping of the wire section in said predetermined position to be gripped.

14. The combination of claim 2 including a stop shoulder on the head engaged with a stop shoulder associated with said terminating means, to limit extension of the arm in said second position when the wire section is positioned for termination.

15. The combination of claim 14 including said terminating means, which is non-integral with wire section supply means relative to which said arm pivots.

16. The combination of claim 15 wherein said terminating means includes wire section peening hammer structure.

17. The combination of claim 15 wherein said terminating means includes hammer and anvil structure characterized in that the hammer bodily deflects the wire section toward the anvil, said telescopic interfit of the guide and locating guide providing sufficient clearance to permit corresponding bodily deflection of the head and clamp.

18. The combination of claim 17 including structure to correspondingly sidewardly deflect the head and arm, as the hammer deflects the wire section.

19. The combination of claim 18 including means to yieldably resist tilting of the carriage as the arm deflects sidewardly.

20. The combination of claim 15 including said wire section supply means which includes a locating clamp to clamp the wire section at a mid-portion of the section freely exposed for gripping at axially spaced locations by said wire section gripping clamp on the holder.

21. The combination of claim 20 wherein said wire section supply means also includes associated wire severing and insulation stripping structure.

22. In combination, (a) a wire section supply apparatus including a locating clamp to clamp a wire section at a mid portion thereof, with end portions of the section freeely exposed for gripping, at predetermined locations, (b) a wire section terminating apparatus, spaced from said wire section supply apparatus, (c) arm means including a wire section clamp, associated with one of said supplying apparatus and terminating apparatus, (d) means supporting the arm means for pivotal displacement between first and second positions, and means to pivot the arm means, (e) and means to extend the arm in said second position to effect interfit with the other of said supply apparatus and said terminating apparatus and position the wire section for termination thereof, (f) whereby the arm means may be subsequently retracted and the clamp unclamped, to free the wire section from the arm means.

23. The combination of claim 22 including interfitting locating structure on said arm means and on one of said supply apparatus and terminating apparatus to locate said wire section at said arm second position, in which the arm is extended, for termination.

* * * * *